US005921298A

United States Patent [19]

Miyamoto

[11] Patent Number: 5,921,298

[45] Date of Patent: Jul. 13, 1999

[54] GROOVE FORMING APPARATUS

[75] Inventor: Kouichi Miyamoto, Fuchu, Japan

[73] Assignee: Ryobi Limited, Japan

[21] Appl. No.: 09/016,894

[22] Filed: Feb. 2, 1998

[30] Foreign Application Priority Data

Feb. 14, 1997 [JP] Japan ..... 9-030819

[51] Int. Cl.[6] ..... B27G 5/06; B27C 5/02

[52] U.S. Cl. ..... 144/136.95; 144/137; 144/144.1; 144/154.5; 409/137; 409/182

[58] Field of Search ..... 144/134.1, 136.95, 144/137, 144.1, 154.5, 371, 372; 409/182, 137

[56] References Cited

U.S. PATENT DOCUMENTS

| | | | |
|---|---|---|---|
| 4,561,478 | 12/1985 | Fields | 144/144.1 |
| 4,909,680 | 3/1990 | Wolff | 144/136.95 |
| 4,947,908 | 8/1990 | O'Banion et al. | 144/136.95 |
| 5,697,415 | 12/1997 | Kozyrski et al. | 144/136.95 |

*Primary Examiner*—W. Donald Bray
*Attorney, Agent, or Firm*—Brooks & Kushman P.C.

[57] ABSTRACT

There is provided a groove forming apparatus which permits easy formation of a curved groove such as a semicircular groove or the like, resulting in high degree of freedom in working. The apparatus comprises a trimmer 1 provided with a chuck 11 capable of coaxially supporting a straight bit 17 and with a rotation mechanism 12 arranged behind the chuck 11, for rotating the chuck 11 around an axial line thereof; and a supporting body 2 arranged ahead of the chuck 11 and having an abutment surface 37 with which a work W is to be in contact, for supporting the trimmer 1 so as to be movable back and forth in a direction perpendicular to the abutment surface 37 and swingable along a plane perpendicular thereto. A tracing pin 33 movable together with the trimmer 1 is moved along the groove portion 32 formed on the gauge plate 31 of the supporting body 2. The tip end 17a of the bit 17 attached to the chuck 11 is moved along a curve corresponding to the shape of the groove to be formed on the work W, to form the semi-circular or semi-elliptic groove on the work W.

8 Claims, 6 Drawing Sheets

(a)

(b)

GROOVE FORMING APPARATUS

BACKGROUND OF THE INVENTION

1. Field of the Invention

The present invention relates to a groove forming apparatus for carrying out working such as a biscuit groove forming on wood.

2. Description of the Related Art

As a method for connecting a pair of wood plates to each other, there has been known a method which comprises the steps of forming a semicircular groove so called a "biscuit groove" on each of the contacting surfaces of the wood plates, applying an adhesive agent to the both grooves of the wood plates and inserting a connecting disc plate so called a "biscuit" in the both grooves thereof. With respect to an apparatus for forming such a biscuit groove, a hand-held apparatus for forming a semicircular groove on wood by the rotation of a disc-shaped cutter is disclosed for example in Japanese Patent Publication No. H6-26801.

However, the conventional groove forming apparatus described above permits the formation of only a specific biscuit groove having the curvature corresponding to the diameter of the cutter, resulting in low degree of freedom in working. When the depth of cut is increased, for example, the length of the groove is also increased accordingly, thus making it substantially impossible to form a groove having a deep depth. The change in shape of the groove always requires the replacement of the cutter, thus deteriorating the workability. The groove forming apparatus has a large front end portion with which the disc-shaped cutter should be covered, thus causing the entire apparatus to be heavy, with the result that a heavy burden is imposed on an operator who handles the groove forming apparatus.

SUMMARY OF THE INVENTION

An object of the present invention is therefore to provide a groove forming apparatus which permits easy formation of a curved groove such as a semicircular groove or the like without using a disc-shaped cutter, resulting in high degree of freedom in working.

In order to attain the aforementioned object, a groove forming apparatus comprises a working body (1) provided with a chuck (11) capable of coaxially supporting a straight bit (17) and with a rotation mechanism (12) arranged behind said chuck (11), for rotating the chuck (11) around an axial line thereof; and a supporting body (2) arranged ahead of said chuck (11) and having an abutment surface (37) with which an object to be worked (W) is to be brought into contact, for supporting said working body (1) so as to be movable back and forth in a direction perpendicular to said abutment surface (37) and swingable along a plane perpendicular to said abutment surface (37).

There may be provided a copying means (31, 33) for regulating moving directions of said working body (1) relative to said supporting body (2) so that a tip end **(17*a*) of said straight bit (17) supported by said chuck (11) moves along a curved line corresponding to a shape of a groove to be formed on said object to be worked (W), when said working body (1) is advanced toward said abutment surface (37)** and swung.

The above-mentioned copying means may comprise a gauge plate (31) provided on said supporting body (2) and having a groove portion (32); and a tracing pin (33) provided so as to be movable together with said working body (1), said tracing pin being to be brought into contact with an inner wall **(32*a*) of said groove portion (32) and movable along said inner wall (32*a*) when said working body (1) is advanced toward said abutment surface (37)**.

The above-mentioned supporting body (2) may be provided with: a base portion (22) mountable on said object to be worked (W); a guide portion (21) for supporting said working body (1), said guide portion (21) being combined with said base portion (22) so as to be movable in a direction of a central axis of a swing motion of said working body (1); and a position adjusting means (39) for causing said guide portion (21) to be moved in the direction of the central axis of said swing motion relative to said base portion (22).

The above-mentioned base portion (22) may be provided with a grip portion (38) which can be grasped by an operator.

A pressing means (34) may be provided for imparting force to said working body (1), which has a function of keeping said working body (1) away from the abutment surface (37) of said supporting body (2).

The above-mentioned supporting body (2) may be provided with a guide portion (21) having elongated holes (26) which extend in a direction perpendicular to said abutment surface (37), and with a holding portion (20) having a guide pin (25) which is fitted into said elongated holes (26) so as to be slidable therein; and the above-mentioned working body (1) may be mounted on said holding portion (20).

The above-mentioned gauge plate may be replaceable.

DETAILED DESCRIPTION OF THE PREFERRED EMBODIMENTS

Now, one of embodiments of a groove forming apparatus of the present invention will be described in detail below with reference to the accompanying drawings.

Figure 1:
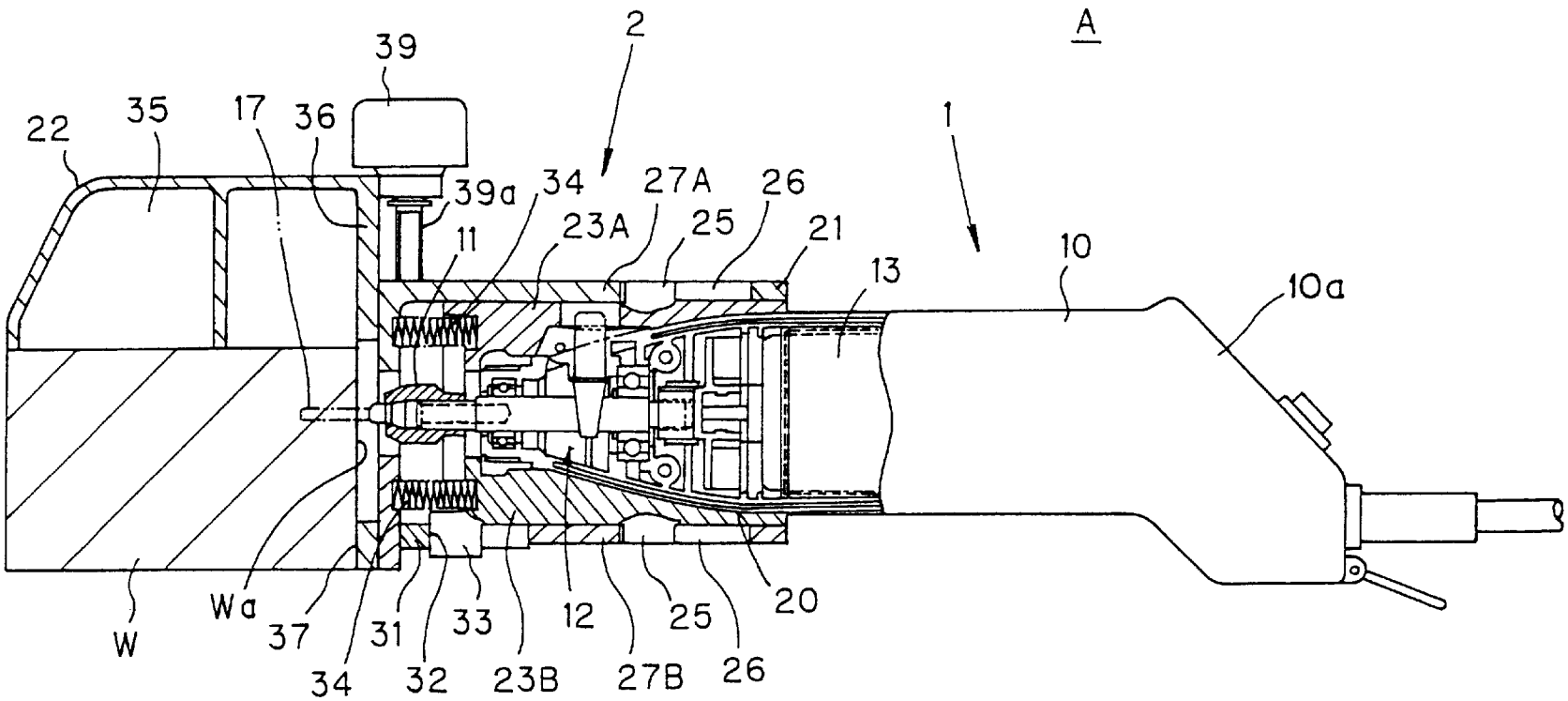
FIG. 1 is a longitudinal cross-sectional view illustrating a biscuit groove forming apparatus to which the present invention is applied.
Figure 2:
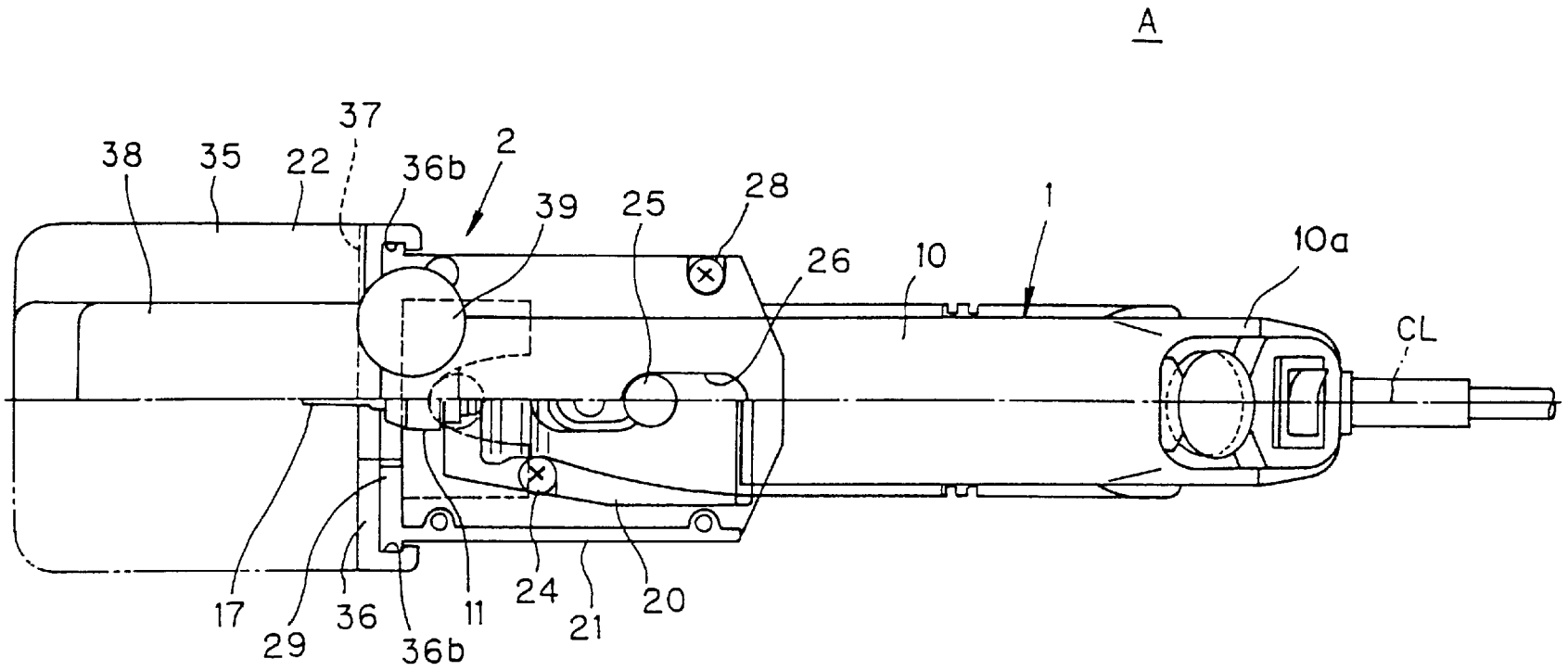
FIG. 2 is a plan view of the groove forming apparatus as shown in FIG. 1.

FIGS. 1 and 2 show the entire construction of the groove forming apparatus to which the present invention is applied. The groove forming apparatus A comprises a trimmer 1 as a working body, and a supporting means 2 for supporting the trimmer 1 under a prescribed position thereof relative to a work W, i.e., an object to be worked. The upper side from the central line CL as shown in FIG. 2 illustrates the appearance of the groove forming apparatus A when it is seen from the above, and the lower side therefrom illustrates the internal structure of the apparatus A. The left-hand side of FIGS. 1 and 2 corresponds to the front side of the apparatus A, and the right-hand side thereof corresponds to the rear side the apparatus A.

Figure 3:
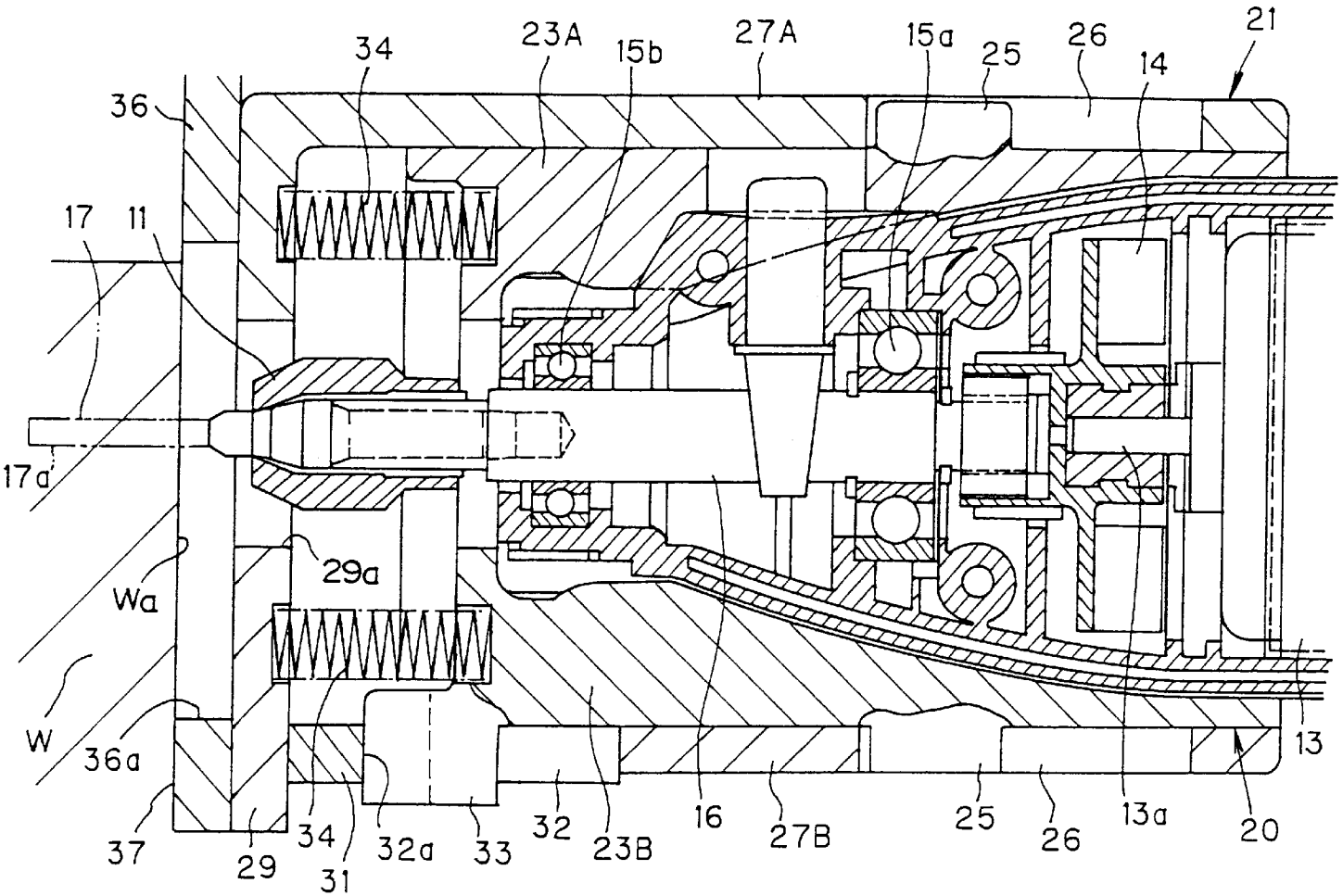
FIG. 3 is an enlarged partial view of the groove forming apparatus as shown in FIG. 1.

The trimmer 1 is provided with a housing 10 and a chuck 11 as shown in detail in FIG. 3, and in the housing 10, there is involved a rotation mechanism 12 for rotating the chuck 11 around an axial line thereof. The rotation mechanism 12 has a motor 13 as a driving power source, a fan secured to the output shaft 13*a* of the motor 13, a pair of bearings 15*a*, 15*b* supported on the housing 10, and a transmission shaft 16 rotatably supported by means of these bearings 15*a*, 15*b*, one end of which is connected to the chuck 11 and the other end of which is connected to the fan 14. The rotation mechanism 12 is not limited to that having a structure as shown in FIG. 3, and may be modified into various embodiments in accordance with the shape and size of the trimmer 1. A straight bit 17 can coaxially be fitted to the front end of the chuck 11. The housing 10 has at a rear portion thereof a grip portion 10*a*, which can be grasped by an operator with a single hand.

The supporting body 2 has a holder 20 as a holding portion into which the front end portion of the trimmer 1 is fitted, a cylindrical guide 21 as a guide portion for receiving the holder 20 therein, and a base 22 as a base portion for supporting the guide 21. The holder 20 is provided with a pair of holding blocks 23A, 23B that are combined to each other by means of a screw 24. The holder 20 has an inner surface that is formed so as to be complementary to the outer periphery of the front-end portion of the trimmer 1. As a result, the trimmer 1 and the holder 20 can be combined into an integral body by holding the trimmer 1 by means of the holding blocks 23A, 23B, and combining the holding blocks 23A, 23B with each other by means of the screw 24.

Figure 5:
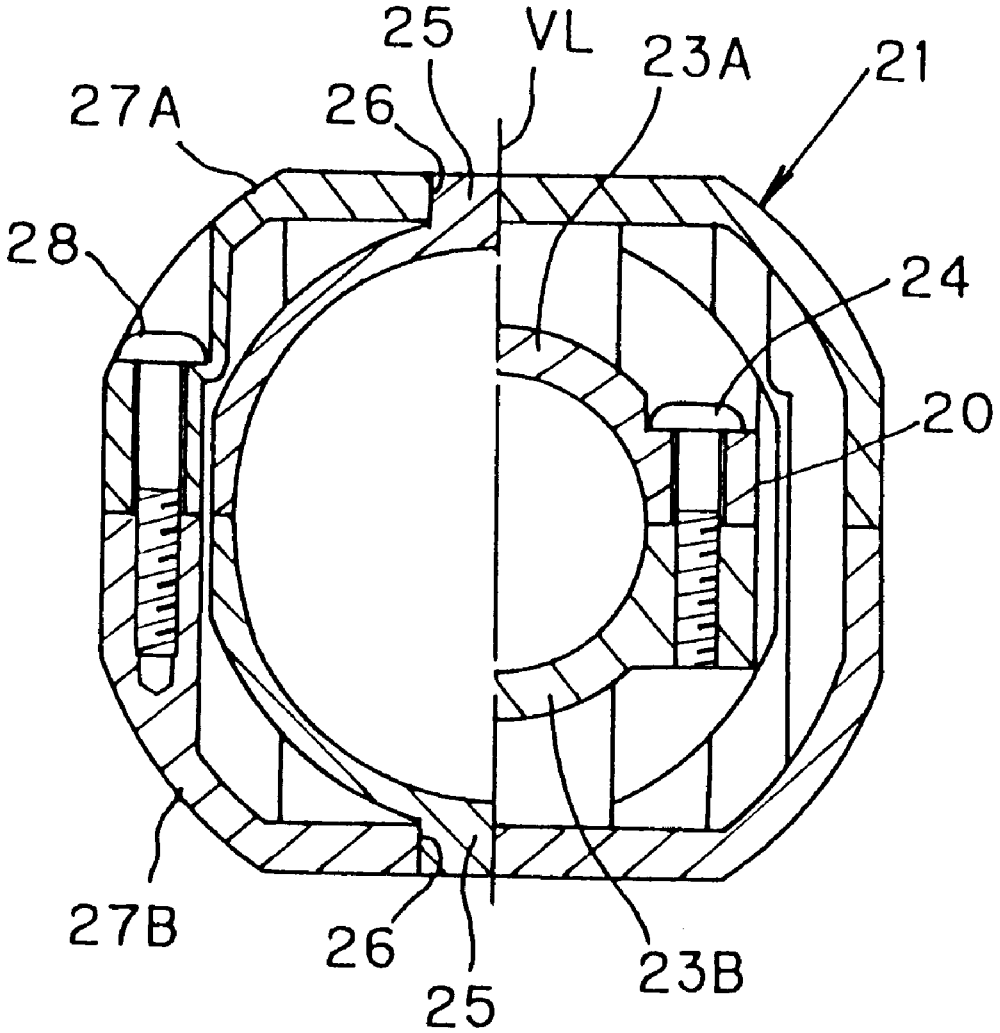
FIG. 5 is a transverse sectional view illustrating the groove forming apparatus as shown in FIG. 1.

The holder 20 is provided on its upper and lower portions with guide pins 25, 25, respectively, which are fitted slidably into elongated holes 26, 26 formed on the guide 21, respectively (refer to FIG. 2). Such a construction causes the holder 220 and the trimmer 1 to be supported so as to be movable in a longitudinal direction of the elongated hole 26 relative to the guide 21 as well as swingable with the guide pin 25 as a fulcrum. The longitudinal direction of the elongated hole 26 is perpendicular to the abutment surface 37 of the supporting body 2, with which the work W is to be brought into contact, and the axial direction of the guide pin 25 is in parallel with the above-mentioned abutment surface 37. The left-hand side from the vertical central line VL as shown in FIG. 5 illustrates a cross-section at the central position of the pin 25, and the right-hand side therefrom illustrates a cross-section at a position in the vicinity of the work W.

The guide 21 is provided with a pair of guiding blocks 27A, 27B that are combined with each other by means of a screw 28. The elongated holes 26, 26 are formed on these guiding blocks 27A, 27B, respectively. The trimmer 1, the holder 20 and the guide 21 can be assembled in an illustrated state by holding the holder 20 by means of the guiding blocks 27A, 27B and tightening the screw 28.

A gauge plate 31 is provided on the lower portion of the guide 21. The gauge plate 31 is detachably secured to the guide 21 with the use of fixing means (not shown) such as for example bolts. As shown in detail in FIG. 3 and FIG. 6(*a*), the gauge plate 31 has a groove portion 32 formed thereon, which is curved in the form of arc or a part of an ellipse. A tracing pin 33 that is movable together with the holder 20 is brought into contact with the above-mentioned groove portion 32 of the gauge plate 31.

On a partition wall 29 provided at the front end of the guide 21, there is formed as shown in FIG. 3 a through-hole 29*a* for causing the chuck 11 and the straight bit 17 attached thereto to be passed. A plurality of compression coil springs 34 . . . 34 as a pressing means are provided between the above-mentioned partition wall 29 and the holder 20. The resiliency of these springs causes the holder 20 to be moved toward the rear portion of the apparatus A along the longitudinal direction of the elongated hole 26 of the holder 20. As a result, the straight bit 17 is completely received in the inside of the guide 21 except for an occasion to carry out the working treatment, thus improving safety. FIGS. 1 and 3 illustrate a condition in which the holder 20 is pressed into the guide 21 against the compression springs 34, and the tracing pin 33 is pressed on the inner wall 32*a* of the groove portion 32 of the guide plate 31.

Figure 4:
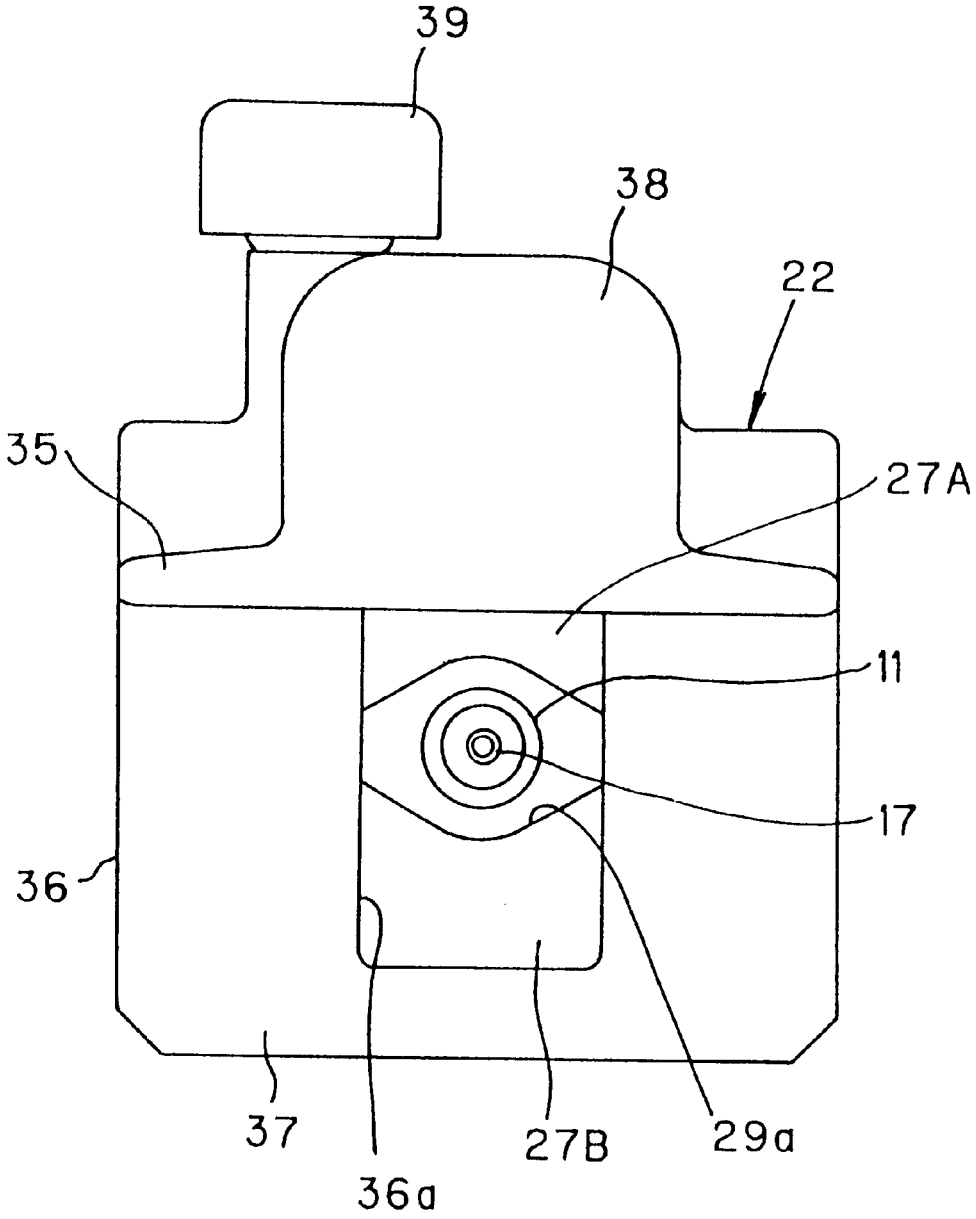
FIG. 4 is a left-hand side view illustrating the groove forming apparatus as shown in FIG. 1.

As shown in FIGS. 1 to 3, there are provided on the base 22 a fence 35 which is to be placed on the upper surface of the work W, and a plate-shaped post 36 secured to the one end of the fence 35 so as to be perpendicular thereto. The above-mentioned post 36 has the abutment surface 37 with which the surface to be worked Wa of the work W is to be brought into contact. The fence 35 has a grip portion 38 formed thereon, which can be grasped by an operator with a single hand as shown in FIG. 4. A through-hole 36*a* is formed on the post 36, for causing the straight bit 17 to be passed therethrough.

The post 36 has at its opposite sides grooves 36*b*, 36*b* formed thereon, which extend vertically, and in which the side end portions of the partition wall 29 of the guide 21 is slidably fitted. As a result, the guide 21 and the base 22 are assembled so that the former is movable in the vertical direction with respect to the latter. An adjusting screw 39 as a position adjusting means is mounted on the base 22 so as to be freely rotatable, and the threaded portion 39*a* of the adjusting screw 39 is screwed on the upper portion of the guide 21. The turning of the adjusting screw 39 causes the guide 21 to be moved in the vertical direction so as to change the cutting position of the straight bit 17 relative to the work W.

Figure 6:
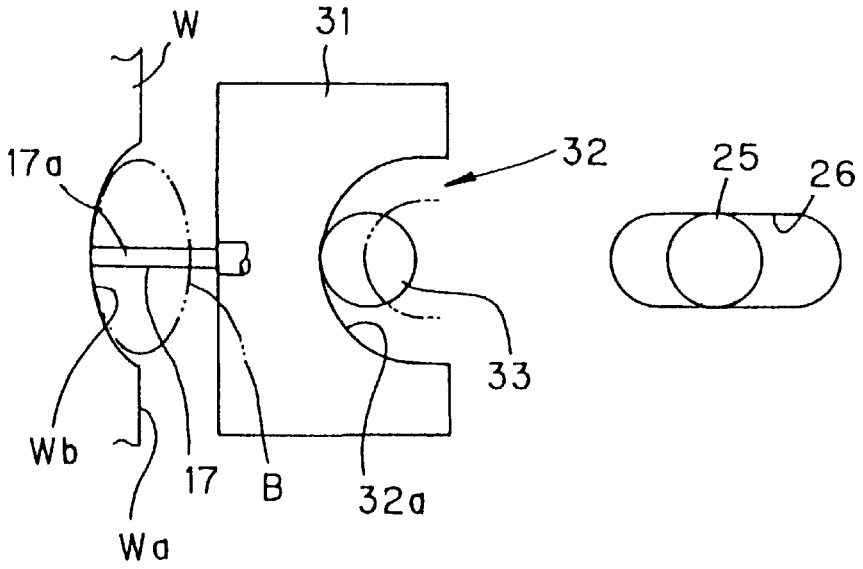
FIG. 6 is a view illustrating the relationship between the groove forming apparatus as shown in FIG. 1 and a biscuit groove formed thereby.
Figure 6:
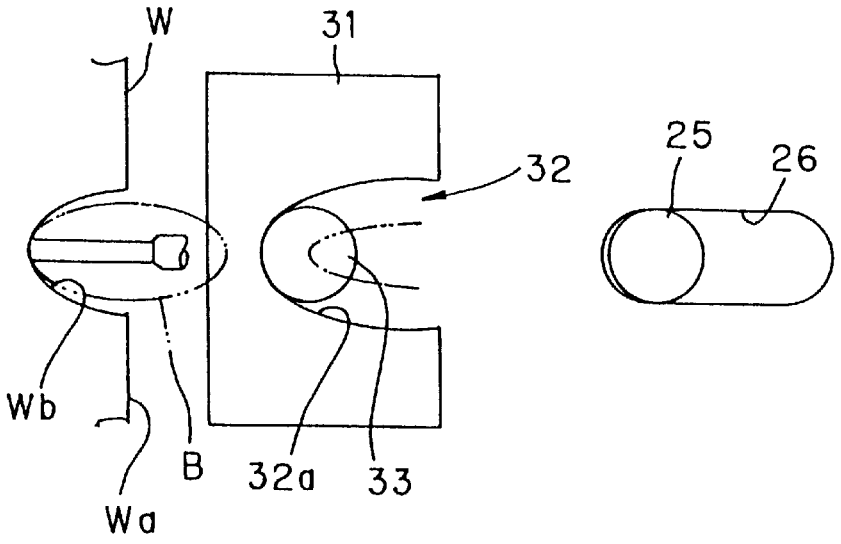

According to the groove forming apparatus having the above-described construction, when the abutment surface 37 of the base 22 is brought into contact with the surface to be worked Wa of the work W, and the trimmer 1 is then pressed forward while rotating the straight bit 17 attached to the chuck 11 by the driving of the motor 13, the tip end 17*a* of the straight bit 17 advances to the inside of the work W to cut it. When the trimmer 1 is swung with the pin 25 as a fulcrum, while causing the tracing pin 33 to be pressed on the inner wall 32*a* of the groove portion 32, the tracing pin 33 is moved along the inner wall 32*a*, resulting in the formation of a biscuit groove Wb having the inner surface which is curved in the form of arc or a part of an ellipse as shown in FIG. 6(*a*). The shape of the groove portion 32 of the gauge plate 31 determines the shape of the thus formed biscuit groove Wb.

FIG. 6(*b*) illustrates an embodiment in which the gauge plate 31 having the groove portion 32 with a different shape is secured, to the supporting body 2. In this embodiment, the gauge plate 31 has the semi-ellipse-shaped groove portion 32*a* formed thereon which is elongated in the longitudinal direction of the apparatus A in comparison with the embodiment as shown in FIG. 6(*a*). Accordingly, it is possible to form the biscuit groove Wb that is deeper than that as shown in FIG. 6(*a*). When there are prepared many kinds of gauge plates having different groove shapes from those of the gauge plates described above, it is possible to carry out many kinds of groove form workings to form biscuit grooves having different shapes. Incidentally, it is prefer to form the biscuit groove Wb having a size which is slightly larger than the size of the biscuit B to be inserted therein, taking into consideration the fact that the biscuit B may swell due to the penetration of an adhesive agent therein.

The present invention is not limited to the embodiments as shown in the figures, and may be directed to many modifications. In an example case, the guide pin 25 and the tracing pin 33 may be provided on the trimmer 1, and the holder 20 may be omitted. The work W is not limited to wood. The position adjusting means composed of the adjusting screw 39 may be omitted. When the screw 28 is removed and the guide 21 is divided into two parts, and the screw 24 is then removed and the holder 20 is also divided into two parts, the trimmer 1 can be separated from the supporting body 2. The separated trimmer 1 from the supporting body 2 can be utilized alone for the purpose other than the groove formation.

According to the present invention as described above, the combination of the back and forth movement of the working body relative to the supporting body and the swing motion of the working body relative thereto permits the formation of the groove having an arch-shape or the like with the use of the straight bit, thus making it possible to remarkably increase degree of freedom in working in comparison with the conventional apparatus in which the formation of the groove is carried out with the use of the disc-shaped cutter. Especially, it is easy to carry out the formation of the groove having a deep depth. It is possible to achieve various groove-formation with the use of the same bit, with the result that labor to replace the bit can be saved and the working efficiency can be improved. The use of the straight bit causes the front end portion of the apparatus to be compact in comparison with that of the conventional apparatus, thus reducing the operator's burden.

According to the present invention, the shape of the groove to be formed can be changed variously in accordance with the component of the copying means, thus permitting precise and easy formation of the groove. According to the present invention, it is possible to make a prescribed arcuate or elliptic motion of the tip end of the straight bit only by moving the tracing pin along the inner wall of the groove portion, and the replacement of the gauge plate makes it possible to form various grooves having different shapes with the use of the same bit. According to the present invention, it is possible to move the working body in a direction of the central axis of the swing motion thereof to adjust the working position relative to the work. The apparatus can firmly be supported in the vicinity of the working position by grasping the grip portion of the base by an operator, thus improving stability during working. According to the present invention, the straight bit can completely be received in the inside of the supporting body except for an occasion to carry out the working treatment, thus improving safety of the apparatus. The only fitting of the guide pins of the holder to which the working body is secured, into the elongated holes of the guide, makes it possible to support the working body so as to be movable in the longitudinal direction of the elongated hole (i.e., in a direction perpendicular to the abutment surface with which the work is to be brought into contact), as well as to be swingable with the guide pin as a fulcrum. According to the present invention, the only replacement of the gauge plate in accordance with the shape of the groove to be formed causes the prescribed groove form working to be carried out, with the result that labor to replace the bit can be saved and the working efficiency can be improved.

What is claimed is:

1. A groove forming apparatus which comprises:

a working body provided with a chuck capable of coaxially supporting a straight bit and with a rotation mechanism disposed behind and connected to said chuck, for rotating the chuck around an axial line thereof; and a supporting body connected to a front end portion of said working body and having an abutment surface with which an object to be worked is to be brought into contact, for supporting said working body so as to be movable back and forth in a direction perpendicular to said abutment surface and swingable along a plane perpendicular to said abutment surface.

2. An apparatus as claimed in claim 1, wherein:

there is provided a copying means for regulating moving directions of said working body relative to said supporting body so that a tip end of said straight bit supported by said chuck moves along a curved line corresponding to a shape of a groove to be formed on said object to be worked, when said working body is advanced toward said abutment surface and swung.

3. An apparatus as claimed in claim 2, wherein:

said copying means comprises:

a gauge plate provided on said supporting body and having a groove portion; and a tracing pin provided so as to be movable together with said working body, said tracing pin being to be brought into contact with an inner wall of said groove portion and movable along said inner wall when said working body is advanced toward said abutment surface.

4. An apparatus as claimed in claim 1, wherein:

said supporting body is provided with:

a base portion mountable on said object to be worked;

a guide portion for supporting said working body, said guide portion being combined with said base portion so as to be movable in a direction of a central axis of a swing motion of said working body; and a position adjusting means for causing said guide portion to be moved in the direction of the central axis of said swing motion relative to said base portion.

5. An apparatus as claimed in claim 4, wherein:

said base portion is provided with a grip portion which can be grasped by an operator.

6. An apparatus as claimed in claim 1, wherein:

a pressing means is provided for imparting force to said working body, which has a function of keeping said working body away from the abutment surface of said supporting body.

7. An apparatus as claimed in claim 1, wherein:

said supporting body is provided with a guide portion having elongated holes which extend in a direction perpendicular to said abutment surface, and with a holding portion having a guide pin which is fitted into said elongated holes so as to be slidable therein; and said working body is mounted on said holding portion.

8. An apparatus as claimed in claim 3, wherein:

said gauge plate is replaceable.

* * * * *